United States Patent [19]

Watanabe

[11] Patent Number: 4,529,498

[45] Date of Patent: Jul. 16, 1985

[54] METHOD FOR PRODUCING MESOPHASE PITCH

[75] Inventor: Masami Watanabe, Tokyo, Japan

[73] Assignee: Kashima Oil Company Limited, Tokyo, Japan

[21] Appl. No.: 507,584

[22] Filed: Jun. 24, 1983

[51] Int. Cl.[3] ..... C10C 3/00

[52] U.S. Cl. ..... 208/44; 208/22; 208/39; 208/40; 423/447.2

[58] Field of Search ..... 208/44, 40, 39, 22

[56] References Cited

U.S. PATENT DOCUMENTS

| | | | |
|---|---|---|---|
| 3,928,170 | 12/1975 | Takahashi | 208/40 |
| 3,974,264 | 8/1976 | McHenry | 423/447.4 |
| 3,976,729 | 8/1976 | Lewis et al. | 423/447.6 |
| 4,005,183 | 1/1977 | Singer | 208/44 |
| 4,026,788 | 5/1977 | McHenry | 208/40 |
| 4,032,430 | 6/1977 | Lewis | 423/447.1 |
| 4,209,500 | 6/1980 | Chwastiak | 208/44 |
| 4,303,631 | 12/1981 | Lewis et al. | 423/447.1 |
| 4,317,809 | 3/1982 | Lewis et al. | 208/39 |

FOREIGN PATENT DOCUMENTS

| | | | |
|---|---|---|---|
| 0044714 | 1/1981 | European Pat. Off. | 208/44 |
| 0027739 | 4/1981 | European Pat. Off. | 208/44 |
| 0102690 | 8/1980 | Japan | 208/40 |
| 0047385 | 3/1982 | Japan | 423/447.2 |
| 2099845 | 12/1982 | United Kingdom | 208/22 |

*Primary Examiner*—D. E. Gantz
*Assistant Examiner*—Helane Myers
*Attorney, Agent, or Firm*—Armstrong, Nikaido, Marmelstein & Kubovcik

[57] ABSTRACT

A method for producing a 100% mesophase pitch composed only of Q.I. and Q.S. components is provided. This method comprises subjecting petroleum-origin pitch to heat treatment with stirring under a stream of a hydrocarbon gas of small carbon atom numbers at atmospheric or superatmospheric pressure, holding said heat-treated pitch in quiescent state to melt and coalesce only the mesophase therein and dividing and separating non-mesophase and mesophase layers. Resulting 100% mesophase enables us to produce high strength, high modulus carbon fibers.

4 Claims, No Drawings

METHOD FOR PRODUCING MESOPHASE PITCH

BACKGROUND OF THE INVENTION

This invention relates to a method for producing 100% mesophase pitch, as a raw material for high strength, high modulus carbon fibers. More particularly it relates to a method for producing 100% mesophase pitch which enables us to produce with a high efficiency and at a low price, high strength, high modulus carbon fibers which are preferable as a raw material for composite articles.

DESCRIPTION OF PRIOR ART

As the result of recent rapid growth of industries for manufacturing aircrafts, motor vehicles and other transport a demand for materials capable of exhibiting remarkable characteristics because of the superiority of some of their physical properties is ever increasing. Particularly, the demand for the advent of inexpensive materials provided with high strength and high modulus together with lightness of weight is great. However, since the material which satisfies the above-mentioned demand cannot be supplied in a stabilized manner according to the present status of art, research works relative to composite articles (reinforced resins) which meet the above-mentioned requirement are prevailing.

As one of the most promising material to be used as reinforced resin, there can be mentioned high strength high modulus carbon fibers. These materials have appeared from about the time when the rapid growth of the above-mentioned industry just started. When the carbon fibers are combined with a resin, it is possible to produce reinforced resins capable of exhibiting characteristic feature unparalleled in the past. To be regretful enough, however, in spite of the high strength and high modulus of the carbon fibers for the above-mentioned reinforced resins capable of exhibiting extremely notable characteristic feature, the application fields of these fibers have not expanded. The cause of this fact, as explained later, lies in the higher production cost.

It is well known that the material for high strength, high modulus carbon fibers which are commercially available are mostly polyacrylonitrile fibers produced by a special production process and a special spinning process but these acrylonitrile fibers are not only expensive as a precursor of carbon fibers but also the production yield thereof from the precursor is as low as less than 45%. These facts complicate the treatment steps for producing superior carbon fibers, resulting in the increasing production cost of the ultimate products of carbon fibers.

As for the methods for producing inexpensive raw materials for carbon fibers, there are many reports in such as U.S. Pat. No. 3,974,264 and U.S. Pat. No. 4,026,788 issued to E. R. McHenry and assigned to Union Carbide Corporation etc. Beside these, there are many reports in the official gazettes of patent publications. According to these methods, petroleum origin pitch or tar-origin pitch is subjected to heat treatment at a temperature of 380° C. to 440° C. to produce a pitch containing 40% to 90% preferably 50% to 65% mesophase and resulting products are used, as they are, for raw materials for carbon fibers. Accordingly, these products contain a large amount of non-mesophase pitch and cannot be called as 100% mesophase pitch which is required as a raw material for high strength, high modulus carbon fibers and is not provided with the characteristic properties of 100% mesophase pitch.

Further, there is a method which is directed to the production of a mesophase claiming to be essentially 100% mesophase, in the official gazette of Japanese laid open patent No. 55625 of 1979. According to this method, inert gas such as nitrogen, argon, xenon, helium, steam, etc. in a very large amount e.g. at least 8 l per kg raw material per minutes is introduced under pressure into isotropic pitch which is then subjected to heat treatment at a temperature of 380° C. to 430° C., with vigorous stirring even for 5 to 44 hours, until it is converted into a single phase system. Thus an attempt is made to produce a so-called 100% mesophase pitch. However, the isotropic pitch of raw material is of so-called huge molecule, complicated and not a pure compound. It contains impurities and forms emulsion. No matter how long a time, inert gas is compressed into and no matter how vigorously stirring treatment is applied to the pitch, it is impossible to simplify the emulsion completely. In any way, it is impossible to avoid the mixing of non-reacted isotropic pitch, completely and resulting product cannot be said to be a 100% mesophase.

It is an object of the present invention to provide a method for producing a 100% mesophase pitch, as a raw material for high strength and high modulus carbon fibers, preferable as a raw material for fabricating composite articles efficiently and at an inexpensive cost.

SUMMARY OF THE INVENTION

The above-mentioned object can be attained by the method of the present invention in which a residuum carbonaceous material formed, as a by-product of a catalytic cracking of vacuum gas oil (F.C.C.) or a thermal cracking of naphtha is subjected, if necessary to a preliminary treatment to produce a precursor* and their resulting precursor is heat treated with stirring under a stream of hydrocarbon gas of small carbon atom numbers, lower melting point naphtha fractions or a dry gas formed as a by-product at the time of heat treatment of raw material under atmospheric or superatomospheric pressure at a temperature of 360°~450° C. for 30 minutes to 30 hours so as to bring the mesophase content in the heat-formed pitch in the range of 10 to 50%, then holding the heat-formed pitch in aging melt-coalescing state under a stream of hydrocarbon gas of small numbers of carbon atom, lower melting point naphtha fractions or a dry gas formed as a by product of the heat treatment of the raw material at a temperature of 290° C. to 350° C. for 5 to 30 hours (which is entirely different treatment condition from the heat-treatment condition) and separating a non-mesophase of the upper layer and a mesophase (easily observable by a polarization microscope) of the lower layer by the difference of physical properties (e.g. specific gravity or viscosity) at the same temperature as the aging melt-coalescing temperature to produce 100% mesophase pitch.

DETAILED DESCRIPTION OF THE INVENTION

Namely, residuum carbonaceous material formed, as a by-product in a catalytic cracking process (F.C.C.) of vacuum gas oil is made into a precursor* under atmospheric stream of a hydrocarbon gas of small numbers of carbon if necessary by subjecting to preliminary heat treatment and resulting precursor is treated at a temperature of 360°~450° C. with stirring for 30 minutes to 30 hours so as to bring the mesophase content in the heat-formed pitch in the range of 10% to 50%.

(*The material obtained by removing volatile fractions will be referred to herein as precursor. The precursor is further subjected to heat treatment generally at a temperature the same or higher than that in the precursor-forming step)

It is possible to produce heat formed pitch containing 20% to 40% mesophase preferably by the heat-treatment carried out by selecting preferably the condition of heating temperature of 380° C. to 440° C. and reaction time of 1~6 hours in order to rationalize the treatment condition with stirring and heating. It is possible to cause only mesophase to melt and coalesce (into huge one body) by holding heat-formed pitch in quiescent state at a temperature of 280° C. to 350° C. which is lower that the heat-treatment temperature, for 5 to 30 hours, under a stream of a hydrocarbon gas of small carbon atom numbers, lower boiling point naphtha fractions, or a dry gas obtained at the heat treatment of raw material of the present invention and further to divide clearly non-mesophase from mesophase at the temperature same as the melting-coalescing aging temperature. If a heating temperature in the melting-coalescing aging state is lower than 280° C., division and separation of heat-formed pitch into non-mesophase and mesophase cannot be carried out.

* The heating reaction for producing mesophase and the aging reaction for melting coalescing produced mesophase are entirely different and by treating these reactions separately, it is only possible to separate 100% mesophase and non-mesophase by the different physical properties (such as specific gravity viscosity, etc.) at the temperature same as the aging and melt coalescing temperature.

As for a carrier gas a stream used at the time of heat treatment as well as at the time of separation of heat formed pitch into non-mesophase and mesophase, a hydrocarbon of small carbon numbers such as methane, ethane, propane, butane or the like or naphtha fractions having lower boiling points which are not converted into heavier materials or pitch can be mentioned. However, economically most excellent gas is a dry gas which is formed as a by-product at the time of heat-treatment of raw material of the present invention (mostly a mixture of hydrocarbons of small carbon number).

Further mesophase can be easily confirmed to be 100% with a polarization microscope. It is preferable to separate non-mesophase and mesophase by selecting the condition of holding in quiescent state at a temperature of 300° C. to 340° C. and a residence time of for 5 to 25 hours in order to rationalize the condition for holding in quiescent state.

Further, it has been found by the inventor of the present invention that divided and separated mesophase is composed of Q.I. (quinoline insoluble portion measured by extraction with quinoline at 80° C.) and Q.S. (quinoline soluble portion) by setting condition for holding in quiescent state and that spinning property of mesophase can be greatly improved by composing the 100% mesophase of 75~87% of Q.I. component and 13~25% of Q.S. component.

The feature of the present invention lies in the point that the mesophase is composed only of Q.I. meso component and Q.S. meso component immediately upon the production of the 100% mesophase.

One example for producing carbon fibers by spinning 100% mesophase composed only of Q.I. and Q.S. component is set forth as follows.

The fibers obtained by spinning 100% mesophase composed only of Q.I. and Q.S. components at a spinning temperature of 320° C. and a viscosity of 50 poise (at the spinning temperature) and a spinning velocity of 100 m/min are subjected to thermosetting (crosslinking) with air at a temperature of 300° C. for 15 minutes and then subjected to carbonization at a temperature rising velocity of 10° C./min. and at an ultimate temperature of 1400° C. for 15 minutes to produce carbon filament yarns having high strength and high modulus.

The invention entitled "Method for producing mesophase-containing pitch by using carrier gas" filed by the inventor of the present application on the same day with the present application had been utilized in the present invention and the description of this application is incorporated herein by reference.

It is a very important point that the reason of separability of the non-mesophase of the upper layer from the 100% mesophase of the lower layer after the aging melt coalescing step has intimate relation with the preceding heat treatment condition.

Following examples are set forth for the purpose of illustration for those skilled in the art but not for the purpose of limiting the invention in any manner.

EXAMPLE 1

A residuum carbonaceous material which is formed as a by-product in a catalytic cracking process (F.C.C.) of vacuum gas oil was subjected to heat treatment of 400° C. for 2 hours under a stream of hydrocarbon gas of small carbon numbers, to produce a precursor pitch.

The yield of the precursor was 54% and the softening point of the precursor (corresponding to R & S) was 67° C.

Resulting precursor was treated under the following heat-treatment condition and then heat-formed pitch was held at a temperature of 300° C. for 24 hours in quiescent state and separation of, the divided non-mesophase layer and mesophase layer was carried out by using, as a carrier gas, a dry gas formed in the heat treatment reaction and recycled.

| | | Result of atmospheric heat treatment | | | |
|---|---|---|---|---|---|
| Experiment Number | | 1 | 2 | 3 | 4 |
| Amount of precursor (gr) | | 1500 | 1500 | 1500 | 1500 |
| Heating condition | Temperature (°C.) | 380 | 400 | 420 | 440 |
| | Time (hr) | 20 | 6 | 2 | 45 minutes |
| Pitch | Formed amount (gr) | 1,143 | 1,313 | 1,296 | 1,263 |
| | Yield (%) | 76.2 | 87.5 | 86.4 | 84.2 |
| Distilled | Formed amount (gr) | 143 | 116 | 130 | 195 |

-continued

| Experiment Number | | Result of atmospheric heat treatment 1 | | 2 | | 3 | | 4 | |
|---|---|---|---|---|---|---|---|---|---|
| oil | Yield | 9.5 | | 7.7 | | 8.6 | | 6.2 | |
| Yield gas (wt %) | | 14.3 | | 4.8 | | 5.0 | | 6.2 | |
| Property of pitch | | Non-meso | Meso | Non-meso | Meso | Non-meso | Meso | Non-meso | Meso |
| Yield of each phase (wt %) | | 66.4 | 33.6 | 78.9 | 21.1 | 79.3 | 20.7 | 68.1 | 31.9 |
| Flow test | Softening point (°C.) | 229 | | 246 | | 226 | | 225 | |
| | Softening point (°C.) corresponding to R & B | 308 | | 309 | | 298 | | 312 | |
| Meso-phase fraction | Q.I. component (%) | 76.7 | | 74.2 | | 79.7 | | 75.8 | |
| | Q.S. component (%) | 23.3 | | 25.8 | | 20.3 | | 24.2 | |

The measurement of softening point corresponding to R & B was carried according to JISK-2531.

EXAMPLE 2

Heat-formed pitch prepared according to Experiment No. 2 of example 1 was subjected to mesophase separation test under the following condition for holding in quiescent state immediately after formation.

| Experiment Number | | Result of meso-phase separation test 5 | | | 6 | | 7 | | 8 | | 9 | | 10 | |
|---|---|---|---|---|---|---|---|---|---|---|---|---|---|---|
| Holding in quiescent state | Temperature (°C.) | 260 | | | 280 | | 300 | | 300 | | 320 | | 340 | |
| | Time (hr) | 16 | | | 16 | | 16 | | 24 | | 16 | | 16 | |
| Property of pitch | | non-meso | meso | upper meso | non-meso | meso | non-meso | meso | non-meso | meso | non-meso | meso | non-meso | meso |
| Yield of each phase (wt %) | | unseparable | | 7.2 | 83.6 | 9.2 | 84.4 | 15.6 | 78.9 | 21.1 | 84.8 | 15.2 | 84.4 | 15.6 |
| Flow test | Softening point | | | 219 | | 209 | | 223 | | 246 | | 232 | | 231 |
| | Softening point corresponding to R & B | | | 282 | 112 | 287 | 116 | 294 | 118 | 309 | 120 | 299 | 129 | 302 |
| Meso-phase fraction | Q.I. component (%) | | | 66.4 | 2.4 | 76.8 | 1.4 | 84.1 | 1.8 | 74.2 | 2.0 | 82.9 | 2.6 | 77.7 |
| | Q.S. component (%) | | | | | 23.2 | | 15.9 | | 25.8 | | 17.1 | | 22.3 |

Under condition of holding in quiescent state of experiment number 6. Clear-cut separation into non-mesophase layer and mesophase layer could not be made and only division into 3 layers was effected. Thus the condition for holding in quiescent state was insufficient.

EXAMPLE 3

Residuum carbonaceous material having a boiling points of 200° C. or higher, which was formed as by-product in thermal cracking of naphtha was treated under the following heat-treatment condition, under a stream of methane gas.

| Experiment number | | Result of atmospheric heat-treatment 11 | 12 | 13 |
|---|---|---|---|---|
| heating condition | temperature (°C.) | 380 | 380 | 380 |
| | time (hr) | 9 | 14 | 17 |
| Yield of pitch (wt %) | | 24 | 22 | 19.5 |
| | Softening point | 162 | 166 | 190 |
| Flow test | Softening point corresponding to R & B | 210 | 218 | 256 |
| Q.I. component of pitch (%) | | 18.1 | 25.8 | 37.6 |

The measurement of softening point corresponding to R & B was carried out according to JISK-2531.

The heat-formed pitch prepared according to experiment number 11 was subjected to mesophase separation test under stream of methane gas under the condition for holding in quiescent state immediately after preparation.

| Experiment number | | Result of mesophase separation test 14 | | 15 | | 16 | |
|---|---|---|---|---|---|---|---|
| holding in quiescent state | temperature (°C.) | 260 | | 280 | | 300 | |
| | time (hr) | 16 | | 16 | | 16 | |
| property of pitch | | non-meso | meso | non-meso | meso | non-meso | meso |
| Yield of each phase | | unseparable | | 79.3 | 20.7 | 76.6 | 23.4 |
| | softening point (°C.) | | | 152 | 212 | 158 | 224 |
| Flow | softening point (°C.) | | | | 290 | | 296 |

-continued

| Experiment number | | Result of mesophase separation test 14 | | 15 | | 16 |
|---|---|---|---|---|---|---|
| test | corresponding to R & B | | | | | |
| meso-phase frac-tion | Q.I. component (%) | | 1.4 | 76.1 | 1.6 | 77.3 |
| | Q.S. component (%) | | | 23.9 | | 22.7 |

What is claimed is:

1. A method for producing a 100% mesophase pitch composed only of Q.I and Q.S. components useful as a raw material for carbon fibers, which comprises the steps of (i) subjecting a petroleum-origin pitch to heat treatment with stirring under a stream of a carrier gas selected from the group consisting of a hydrocarbon of small carbon numbers, a lower boiling point naphtha fraction and a dry gas by-product of the heat treatment of the raw material petroleum-origin pitch and at an atmospheric or super atmospheric pressure and at a temperature of 360° C. to 450° C. to thereby bring the mesophase content in the resulting pitch within the range of 10% to 50%, (ii) holding the heat-treated pitch in a quiescent aging-coalescing state at a temperature of higher than 280° C. and lower than 350° C., to thereby divide the heat-treated pitch into non-mesophase and mesophase, and (iii) separating the non-mesophase of the upper layer and the mesophase of the lower layer by the difference of physical properties therebetween at the same temperature as the aging-coalescing temperature, thereby providing the 100% mesophase composed only of Q.I. and Q.S. components.

2. A method of producing a 100% mesophase pitch according to claim 1, wherein the holding step is conducted in the presence of a stream of a gas selected from the group consisting of a hydrocarbon gas of small carbon numbers, a lower melting point naphtha fraction and a dry gas formed as a by-product of the heat treatment of the petroleum-origin pitch.

3. A method for producing a 100% mesophase pitch according to claim 1, having a softening point of about 209° to about 246° C.

4. A method for producing a 100% mesophase pitch according to claim 1 having 75–87% of Q.I. components and 13–25% of Q.S. components.

* * * * *